US007928707B2

(12) United States Patent
Gerber et al.

(10) Patent No.: US 7,928,707 B2
(45) Date of Patent: Apr. 19, 2011

(54) METHOD AND APPARATUS FOR POWER MANAGEMENT OF A LOW DROPOUT REGULATOR

(75) Inventors: Johannes Gerber, Unterschleissheim (DE); Matthias Arnold, Freising (DE); Korbinian Huber, Altfraunhofen (DE)

(73) Assignee: Texas Instruments Incorporated, Dallas, TX (US)

( * ) Notice: Subject to any disclaimer, the term of this patent is extended or adjusted under 35 U.S.C. 154(b) by 343 days.

(21) Appl. No.: 12/168,579

(22) Filed: Jul. 7, 2008

(65) Prior Publication Data

US 2009/0039845 A1 Feb. 12, 2009

Related U.S. Application Data

(60) Provisional application No. 61/016,730, filed on Dec. 26, 2007.

(30) Foreign Application Priority Data

Jul. 6, 2007 (DE) ..... 10 2007 031 528

(51) Int. Cl.
*G05F 1/00* (2006.01)
*G05F 1/10* (2006.01)
*G05F 3/02* (2006.01)

(52) U.S. Cl. ..... 323/273; 323/282; 327/540

(58) Field of Classification Search ..... 327/540; 323/273–275, 280, 283, 351

See application file for complete search history.

(56) References Cited

U.S. PATENT DOCUMENTS

| | | | | |
|---|---|---|---|---|
| 7,626,367 | B2 * | 12/2009 | Tsai | 323/273 |
| 2007/0152646 | A1 * | 7/2007 | Godil | 323/282 |
| 2007/0249305 | A1 * | 10/2007 | Hsu et al. | 455/127.5 |
| 2007/0252564 | A1 * | 11/2007 | De Nisi et al. | 323/268 |

OTHER PUBLICATIONS

Oliver Weinfurtner et al, "Advanced Controlling Scheme for a DRAM Voltage Generator System," IEEE Journal of Solid-State Circuits, vol. 35, No. 4, Apr. 2000.

* cited by examiner

*Primary Examiner* — Adolf Berhane
*Assistant Examiner* — Emily Pham
(74) *Attorney, Agent, or Firm* — Robert D. Marshall, Jr.; W. James Brady; Frederick J. Telecky, Jr.

(57) ABSTRACT

A method of switching a low dropout regulator includes determining an actual active time of a power request from an electronic device; enabling the low dropout regulator in response to said power request at a time corresponding to a start of the actual active time of the power request for an active enabled time having a duration at least the same as the actual active time and long enough to sufficiently settle the output voltage of the low dropout regulator; and disabling the low dropout regulator. In embodiments, the active enabled time is prolonged beyond the actual active time of the power request for all or at least some power requests. An electronic device includes circuits for controlling the switching of a low dropout in the described manner.

14 Claims, 3 Drawing Sheets

METHOD AND APPARATUS FOR POWER MANAGEMENT OF A LOW DROPOUT REGULATOR

This patent application claims priority from German Patent Application No. 10 2007 031 528.9, filed 6 Jul. 2007, and from U.S. Provisional Patent Application No. 61/016,730, filed 26 Dec. 2007, the entireties of which are incorporated herein by reference.

FIELD OF THE INVENTION

This disclosure relates generally to switching a low dropout (LDO) regulator; and, in particular, to methods and apparatus for power management of a low dropout regulator.

BACKGROUND

Microcontrollers, microprocessors and other devices used to control integrated circuit devices can be used in many different types of electronic equipment. In many such applications, such devices have a typical usage profile of a very short program execution time (e.g., some microseconds) followed by a transition to a low power mode. In integrated circuits, particularly when used in portable electronic devices, a primary goal is always to save power, so that the batteries used to supply power can maintain a long life.

In many microcontrollers and microprocessors, the digital core and other parts of the device may be supplied with power via a low dropout (LDO) voltage regulator. Such regulator is a linear voltage regulator that regulates the primary supply voltage to provide a stable supply voltage with little voltage drop. However, the LDO regulator itself consumes power; thus, it is desirable to switch the regulator itself off or place it in a low power condition when the microcontroller or other device to be powered is not active. Because the microcontroller or other powered device is sometimes switched on only for a relatively short period of time, this means that the LDO regulator must be switched on and off very quickly. Unfortunately, an LDO regulator designed to achieve quick switching (i.e., switching it on and off, or enabling and disabling it) consumes a large amount of power. In addition, such LDO regulator circuits have long settling times and therefore take a long time to settle after being enabled—typically much longer than the program execution time of a microcontroller or the like. Since the output voltage of the regulator is not able to settle during a relatively short active time, this might lead to unpredictable and incorrect LDO regulator output voltages. Thus, a trade-off is generally required between the switching capability, i.e., the settling time, and the power consumption of an LDO regulator.

Some conventional solutions utilize a window comparator to reduce error in the output voltage of an LDO regulator. The comparator is coupled to the regulator output and continuously monitors the output voltage. If the output voltage goes outside a given tolerance range, then the output voltage is corrected by feeding a current to the corresponding node. The window comparator, however, requires additional circuitry and also some reference voltages. Moreover, the window comparator cannot be switched off during inactive times. Accordingly, the power consumption and chip area requirements are increased.

SUMMARY

The invention provides methods and apparatus for driving a low dropout (LDO) regulator to supply power to an electronic device in a discontinuous way, with reduced complexity and lower power consumption.

In one aspect, the invention provides a method of switching a low dropout regulator.

In one implementation, the method comprises determining an actual active time of a power request from a microcontroller or other electronic device and enabling the low dropout regulator in response to the power request at a time corresponding to a start of the actual active time of the power request for an active enabled time having a duration at least the same as the actual active time, but long enough to sufficiently settle the output voltage of the low dropout regulator, and thereafter disabling the low dropout regulator. The duration of the power request is determined, such that power is provided long enough to perform a specific operation. At the start of the time that the microcontroller or other device makes the power request, the low dropout regulator is enabled or switched on. The low dropout regulator remains enabled for at least the same amount of time as the duration of the power request (i.e., the amount of time that the electronic device requests power from the low dropout regulator). If the duration of the power request is greater than a duration sufficient to settle the output voltage, the regulator is disabled or switched off when the power request ceases. In this way, the power consumed by the regulator is reduced, therefore reducing the demands on the power supply battery. This method is easy to implement by a small extension of the digital control circuit only for enabling the low dropout regulator. There is no additional hardware, like comparators or switches, necessary. The electronic device issuing the power request may, for example, be a microcontroller or a microprocessor.

The step of enabling may be performed by sending an enable signal to the low dropout regulator from an independent digital controller. The digital controller can receive the power request from the electronic device (e.g., a microcontroller) and generate an enable signal, which switches on the low dropout regulator for the duration of the power request. Using a separate digital controller allows only a small modification of the digital circuitry to be achieved, without interfering with the electronic device (e.g., the microcontroller). If the duration of the power request is shorter than required for the output voltage to settle, the digital controller can set a minimum enable time so that the regulator remains enabled for an additional duration after termination of the power request in order to settle the output voltage, when the power request terminates prior to a given minimum settling time.

In another implementation, the method comprises prolonging the active enabled time of the low dropout regulator relative to the actual active time of the power request. The active enabled time of the low dropout regulator (i.e., the duration of time that the low dropout regulator is switched on) is prolonged independently of the actual active time of the power request. This may also be achieved by configuring the digital controller to send an enable signal to the low dropout regulator for prolonging the active enabled time of the low dropout regulator relative to the active time of the power request. For example, a typical low dropout regulator design can show a regulation time constant (time for the circuit to settle after being switched on) of at least an order of magnitude larger than, e.g., a microcontroller's minimum active time, which can be some microseconds. The consequence of this is that the low dropout regulator will not settle if it is only enabled for a couple of microseconds. If a chain of these short active time events (switching the regulator on only for the duration of time of each power request of the microcontroller and switching it off at all other times) occurs, there could be a significant deviation of the regulator output voltage, which can be due to a charge accumulation in either an increasing or decreasing direction on the output capacitor (viz., output capacitance) of the low dropout regulator circuit, since the output voltage is mainly unregulated. The result will be an output voltage that can significantly differ from the intended value, which could cause severe problems in the circuits that are supplied by the regulator. This invention recognizes that at least occasionally prolonging the time that the low dropout regulator is switched on relative to the duration of the power request can compensate for a specific amount of regulator output voltage deviation. Accordingly, a certain deviation of the regulator output voltage is tolerated. In order to prevent the regulator output from deviating more than a specific limit, however, all or some of the enable active time periods of the low dropout regulator are prolonged. Therefore, the regulator output voltage does not drift outside its predetermined tolerance range due to charge accumulation on the output capacitor caused by switching the low dropout regulator on for a duration of less than the time constant of the regulator circuit.

In an advantageous embodiment, the active enabled time of the low dropout regulator is prolonged for every nth power request. The number n can be determined empirically, as the maximum number of normal length active enabled times of the low dropout regulator plus one. Thus, n−1 is the number of normal length enable times of the low dropout regulator that can be performed before the regulator output voltage exceeds the tolerance range. This allows a relatively steady output voltage to be achieved, while reducing the power consumption, since the time the low dropout regulator is switched on is not prolonged for every single power request. Furthermore, implementation of this method is highly flexible, since the number of significant active phases for on-time prolongation of the low dropout regulator is easily configurable in the digital circuit. For example, n can be a fixed number 2, 4, 8 or 16. Alternatively, n could be made to vary either in a predetermined or dynamically variable way to accommodate long or short term drifting of the output voltage.

Advantageously, n is determined based on a maximum deviation of the output voltage of the low dropout regulator from the target output voltage during an active enabled time of the low dropout regulator. The maximum value of n can be calculated based on the maximum allowable difference of the regulator output voltage compared with the target output. The determining step of the number n can be performed on a statistical or empirical evaluation of the circuits. Even small values of n will allow power to be saved. However, power consumption can be further reduced by increasing n to its maximum possible value, which means decreasing the frequency of prolonged "on times" of the low dropout regulator.

In another aspect, an electronic device is provided that includes circuitry for controlling the switching of a low dropout regulator. In a described embodiment, the device comprises means for determining an actual active time of a power request from an electronic device (e.g., a microcontroller), switching means for enabling and disabling the low dropout regulator, and a control means for controlling the switching means to enable the low dropout regulator at a time corresponding to a start of the actual active time of the power request, for an active enabled time of a duration at least the same as the actual active time, and long enough to sufficiently settle the output voltage of the regulator circuit, and to disable the low dropout regulator after the active enabled time. The determining means can be adapted to determine the duration of the power request; i.e., the amount of time during which the electronic device requires power to perform a specific operation. At the start of the time that the power request is made, the low dropout regulator is then enabled or switched on by the switching means. The switching means ensures that the low dropout regulator remains enabled for at least the same amount of time as the duration of the power request (the amount of time that the electronic device requests power). The switching means then disables or switches off the low dropout regulator when the power request has ended. In this way, the power consumed by the low dropout regulator is reduced, therefore reducing the demands on the power supply battery.

The switching means can be an independent digital controller. In this way, such a switching circuit can be easily implemented and the electronic device requesting power does not have to be modified in any way.

Advantageously, the device may comprise a means for prolonging the active enabled time of the low dropout regulator relative to the actual active time of the power request. The prolonging means prolongs the active enabled time of the low dropout regulator (the duration of time that the low dropout regulator is switched on) independently of the actual active time of the power request. This may also be achieved by configuring the digital controller to send an enable signal to the low dropout regulator for prolonging the active enabled time of the low dropout regulator relative to the active time of the power request. Prolonging the time that the low dropout regulator is switched on relative to the time taken for the microcontroller power request means that the low dropout regulator is given time to settle and thus the regulator output voltage does not drift outside its predetermined tolerance range due to charge accumulation on the output capacitor caused by switching the low dropout regulator on for a duration of time less than the time constant of the output capacitor. The prolonging means can be set to prolong the active enabled time of the low dropout regulator for only every nth power request. This allows a steady output voltage to be achieved, whilst reducing the power consumption of the low dropout regulator, since the time the low dropout regulator is switched on is not prolonged for every single power request of the microcontroller. As set out above, the number n can be determined empirically, by measurement or by simulations in order to define a ratio of periods of normal active enabled time and periods of prolonged active enabled time of the low dropout regulator. If a maximum value of n is used for the circuit, the power consumed by the circuit is minimized, since the overall switch on or enablement time of the low dropout regulator is minimized. However, even small values of n greater than one provide power reduction. For example, the integer n can be set to be 2, 4, 8 or 16.

BRIEF DESCRIPTION OF THE DRAWINGS

Further features and benefits of the invention will be apparent from the following description of example embodiments, with reference to the accompanying drawings, wherein.

DETAILED DESCRIPTION OF EXAMPLE EMBODIMENTS

Figure 1:
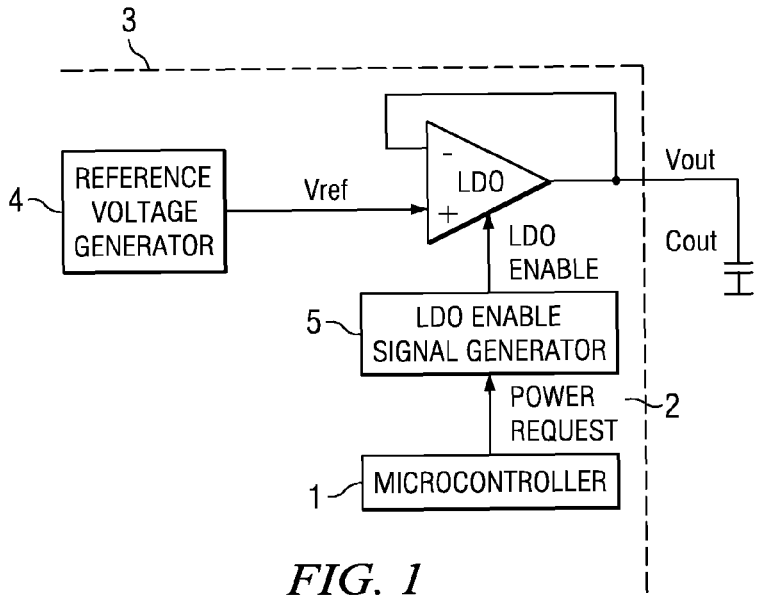
FIG. 1 is a simplified schematic diagram of a low dropout (LDO) regulator circuit for illustrating example implementations of the invention.

FIG. 1 illustrates an example embodiment of a low dropout (LDO) voltage regulator circuit. A microcontroller 1 is provided as part of an integrated circuit on a chip 2. The chip boundary 3 is shown schematically in FIG. 1. The microcontroller 1 is connected to an enable pin of a low dropout regulator LDO via an LDO enable signal generator 5. The low dropout regulator LDO has a positive input terminal coupled to receive a reference voltage Vref generated by a reference voltage generator 4, and a negative input terminal coupled to receive a feedback signal from a regulator output terminal. The output terminal of the low dropout regulator LDO is coupled to provide an output voltage Vout to an output capacitor Cout to buffer the output voltage. The microcontroller 1 is supplied by the output voltage Vout; however, the LDO may also supply other electronic devices. For this embodiment, by way of example only, the microcontroller 1 is considered to be the electronic device that requests power.

In operation, when microcontroller 1 is active, it sends a power request to the LDO enable signal generator 5. The LDO enable signal generator 5 then generates an enable signal that is applied to the enable signal pin of the low dropout regulator LDO, switching on the low dropout regulator LDO. The low dropout regulator LDO then generates an output voltage Vout defined by the reference voltage Vref at the capacitor Cout. When the power request from the microcontroller 1 ends, the LDO enable signal generator 5 stops applying the enable signal to the enable signal pin of the low dropout regulator LDO, which switches off the low dropout regulator LDO. This procedure is repeated each time the microcontroller 1 requests power from the low dropout regulator LDO; i.e., the LDO enable signal generator 5 generates an enable signal that switches on the low dropout regulator LDO for a time period equal to the duration of the power request sent from the microcontroller 1 and switches off the low dropout regulator LDO at all other times when no power request is made by the microcontroller 1.

Figure 2:
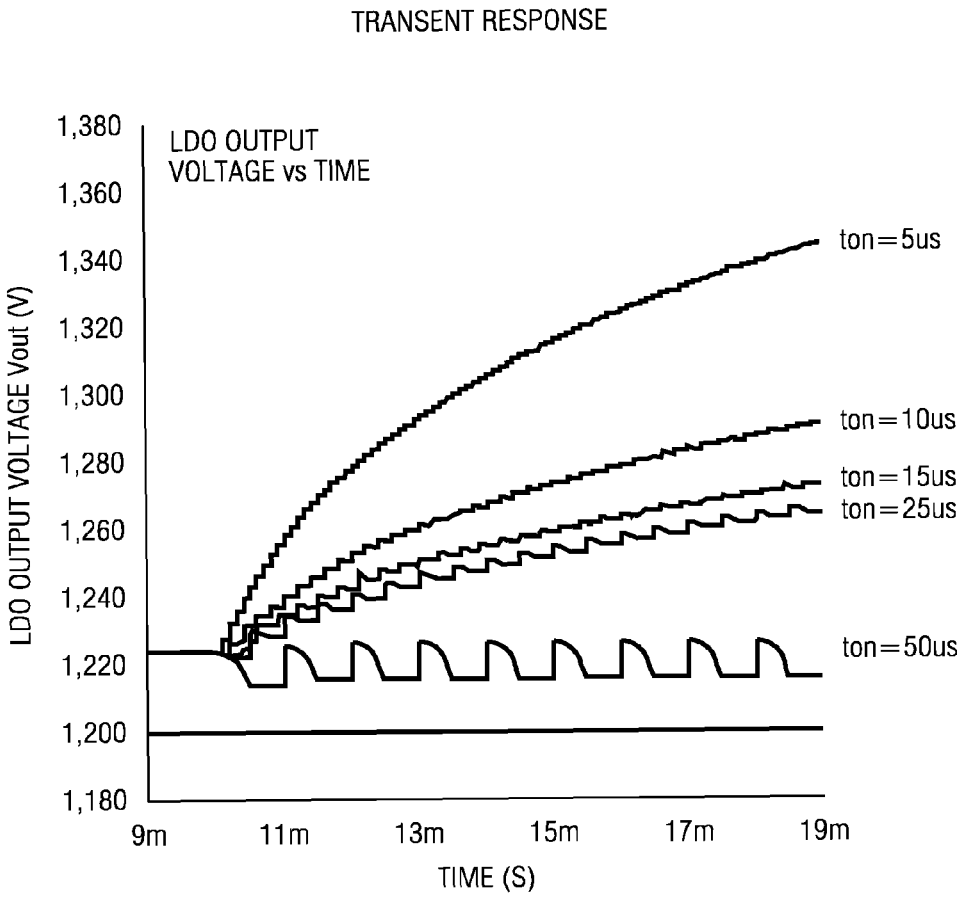
FIG. 2 is a graph illustrating LDO regulator output voltage versus time for the regulator circuit of FIG. 1 in response to periodic power requests made with different time durations.

A graph of the output voltage Vout of the low dropout regulator LDO versus time resulting from periodic requests for power made by microcontroller 1 is shown in FIG. 2. The peaks in the output voltage Vout correspond to the times when the low dropout regulator LDO is enabled by an enable signal from the LDO enable signal generator 5; i.e., corresponding to initiations of a power request from the microcontroller 1. The output voltage Vout is shown for different time durations of the power requests and, thus, for different time durations $t_{on}$ of 5, 10, 15, 25 and 50 μs (microseconds) that the low dropout regulator LDO is switched on. When the low dropout regulator LDO is enabled for successive periodic durations of time $t_{on}$ of 50 μs, the output voltage Vout is stable and constant in between the times when the low dropout regulator LDO is switched on. However, as the time $t_{on}$ is decreased, it can be seen that the output voltage Vout increases in a stepwise manner between each successive one of the periodic switching-on times of the low dropout regulator LDO. This is because, for the illustrated example, $t_{on}$=50 μs is a sufficiently long enough on-time to enable the low dropout regulator circuit, including the capacitor Cout (which may include inherent capacitance of the powered circuit components), to settle after being enabled. However, as $t_{on}$ decreases and approaches more realistic microcontroller minimum active times, it becomes shorter than the time required for the circuit to settle. For these shorter on-times, each time the low dropout regulator LDO is enabled, charge accumulates on the capacitor Cout because the capacitor Cout does not have time to discharge fully before being charged again by the next output of the low dropout regulator LDO. This results in a drift in the output voltage Vout, which is shown in FIG. 2 as a rising increase over time in the output voltage Vout. Such a drift in the output voltage Vout can be tolerated if Vout remains within the voltage tolerance level of the circuits supplied by the low dropout regulator LDO. However, if a stable constant output voltage is required, or if the output voltage Vout is outside the tolerance level of the circuit supplied by the low dropout regulator LDO, the method of switching the low dropout regulator LDO according to this approach would not be suitable.

Figure 3A:
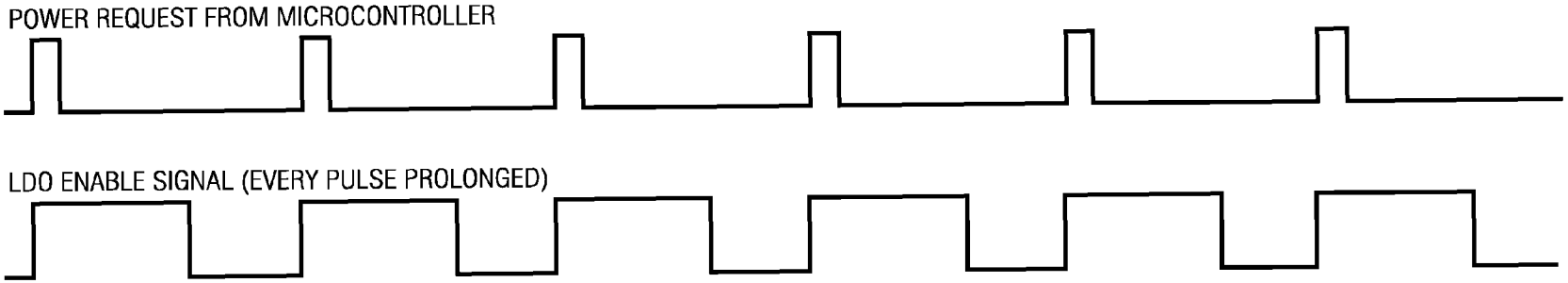
FIGS. 3A and 3B are simplified schematics of a power request signal from a microcontroller and corresponding LDO regulator enable signals for methods of switching according to embodiments of the invention.

FIG. 3A shows signal pulses in the time domain representative of periodic power requests sent from the microcontroller 1, and a corresponding LDO enable signal generated by the LDO enable signal generator 5 in accordance with an example implementation of the invention. With the signals illustrated in FIG. 3A, dropout regulator LDO is not enabled and disabled respectively in exact correspondence with the times that the microcontroller 1 is switched on and off (i.e., only during the active time of the power request from the microcontroller 1). Instead, LDO enable signal generator 5 initiates an LDO enable signal at the same time as the start of the active time of the power request received from the microcontroller 1, but after the active time of the power request from the microcontroller 1 has ended, LDO enable signal generator 5 prolongs the LDO enable signal beyond the active time of the power request so that the low dropout regulator LDO is not switched off until a time after the power request from the microcontroller 1 has ceased. This procedure is repeated for every following power request from the microcontroller 1, so that the LDO enable signal lasts long enough to give the low dropout regulator circuit an appropriate time to settle. The result is that charge does not accumulate on the output capacitor Cout, which means that the resultant output voltage Vout is constant and stable.

A drawback to lengthening the LDO enable signal duration for every power request, as in FIG. 3A, is that the low dropout regulator LDO remains active for an added time following each termination of an actual power request made by the microcontroller 1. This results in additional power utilization after each request in a situation where power is at a premium. However, since the accumulation of charge without such prolongation of the LDO enable signal builds up on the capacitor Cout slowly over several enable/disable events of the low dropout regulator LDO, as seen in FIG. 2, some charge build-up on the capacitor Cout between successive power requests can be tolerated. So, benefits of circuit stabilization by means of enable signal extension may be achieved with less power expenditure by lengthening the duration of the LDO enable signal relative to the duration of the power request at just some of the times, rather than every time. The lengthening may, for example, be conveniently set to occur at regular intervals of every nth time.

Figure 3B:
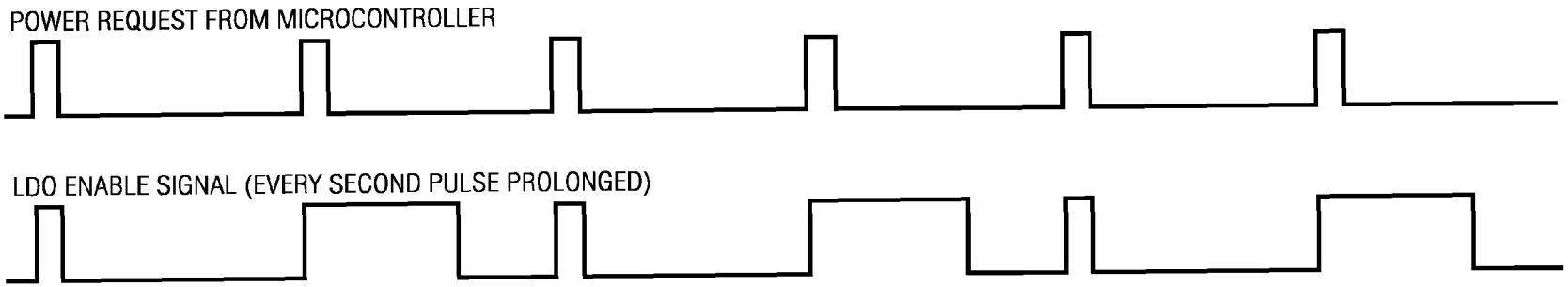

FIG. 3B shows an LDO enable signal generated by the LDO enable signal generator 5 for a modified embodiment of the invention in response to the same periodic power requests from the microcontroller 1. In the example of FIG. 3B, the LDO enable signal generator 5 is operated to prolong the LDO enable signal only for every second power request made by the microcontroller 1. That is, the lengthening occurs at regular intervals of n=2, with each LDO enable signal generated to begin and end with the respective start and stop of a corresponding power request signal being followed by a next LDO enable signal generated to begin with the start of, but end after the stop of, a corresponding next power request signal. The time duration of the extension beyond the stop of the next power request is made long enough to give the low dropout regulator circuit a sufficient time to settle.

A digital control circuit, for example, provided either in the microcontroller 1 or in the LDO enable signal generator 5, allows a prolongation of the enable signal at a given selected one of every $n^{th}$ power request, say for every $2^{nd}$, $4^{th}$, $8^{th}$ or $16^{th}$ power request. This means only every $n^{th}$ enable signal is prolonged to allow the LDO circuit to stabilize and that an accumulation of charge on the output capacitor Cout may occur, but which is tolerated because the resultant output voltage Vout is still within the tolerance range of the circuit supplied by the low dropout regulator LDO. This approach enables a good compromise to be achieved between low power consumption and output voltage stability.

Figure 4:
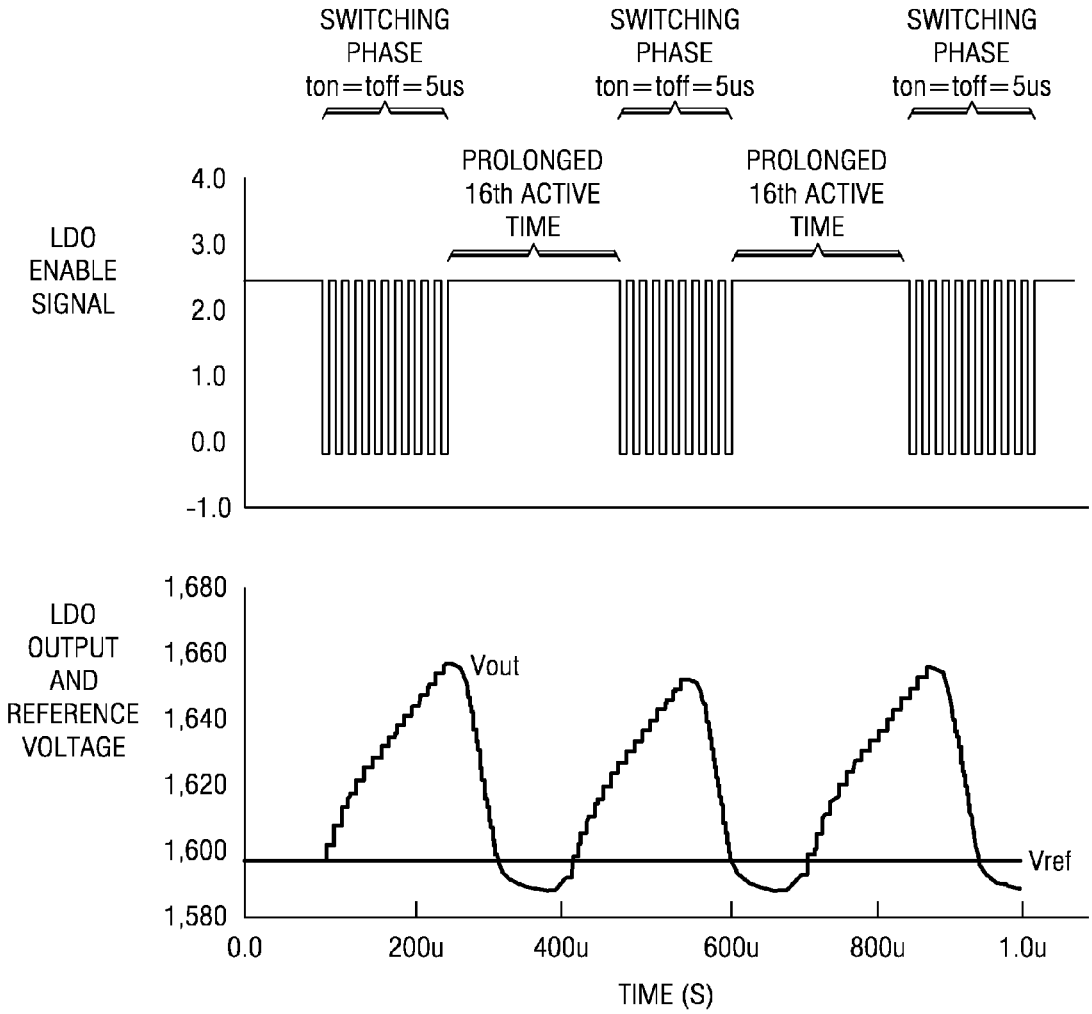
FIG. 4 is a graph of an LDO regulator enable signal and a corresponding LDO regulator output voltage versus time for a method of switching according to another embodiment of the invention.

In FIG. 4, a graph of the LDO enable signal generated by the LDO enable signal generator 5 and corresponding output voltage Vout of the low dropout regulator LDO versus time is shown for another embodiment in which n=16. It can be seen that the LDO enable signal generator 5 is configured to generate an enable signal that normally switches the low dropout regulator on and off every 5 μs; i.e., $t_{on}=t_{off}=5$ μs, and that every $16^{th}$ enable signal is prolonged for over 150 μs. The resultant output voltage Vout from the low dropout regulator LDO drifts slightly relative to the reference voltage Vref, but is still within the acceptable range for the circuits supplied by the low dropout regulator LDO.

A digital controller, provided within the microcontroller 1 or the LDO enable signal generator 5, can be configured and operated to calculate the time required for the output voltage Vout of the low dropout regulator LDO to settle, then calculate the maximum possible value of n that still allows the output voltage Vout to remain within the required tolerance based on the calculated time.

Those skilled in the art will appreciate that the described embodiments are merely example implementations, and that other embodiments and variations are possible within the scope of the claimed invention.

What is claimed is:

1. A method of switching a low dropout regulator, the method comprising:

determining an actual active time of a power request from an electronic device;

enabling the low dropout regulator in response to said power request at a time corresponding to a start of the actual active time of the power request, for an active enabled time having a duration at least the same as the actual active time and duration long enough to sufficiently settle the output voltage of the low dropout regulator;

prolonging the active enabled time of the low dropout regulator relative to the actual active time of the power request, if the active time of the power request is less than a given time for settlement of an output voltage of the low dropout regulator;

prolonging the active enabled time of the low dropout regulator relative to the actual active time of the power request, for every power request; and thereafter disabling the low dropout regulator.

2. The method of claim 1, wherein the low dropout regulator is enabled in response to receipt of an enable signal from a digital controller.

3. The method of claim 1, wherein all other power requests consist of every nth power request, where n is greater than one.

4. The method of claim 3, wherein n=2, 4, 8 or 16.

5. The method of claim 1, wherein a number of the all other power requests is selected relative to a number of the first set of power requests whereby the output voltage remains within a given tolerance margin.

6. The method of claim 5, wherein n=2, 4, 8 or 16.

7. An electronic device including circuits for controlling the switching of a low dropout regulator, the device comprising:

switching means for enabling and disabling the low dropout regulator; and control means for controlling the switching means to enable the low dropout regulator at a time corresponding to a start of an actual active time of a power request for an active enabled time of a duration at least the same as the actual active time and long enough to sufficiently settle the output voltage of the low dropout regulator, and to disable the low dropout regulator after the active enabled time;

means for prolonging the active enabled time of the low dropout regulator relative to the actual active time of the power request, if the active time of the power request is less than a given time for settlement of an output voltage of the low dropout regulator; and means for prolonging the active enabled time of the low dropout regulator relative to the actual active time of the power request, for every power request.

8. The device of claim 7, wherein the switching means is a digital controller.

9. The device of claim 7, further comprising means for selecting all other power requests as every nth power request, wherein n is greater than one.

10. The device of claim 9, wherein n is determined on the basis of a predetermined tolerance range of an output voltage of the low dropout regulator.

11. The device of claim 9, wherein n=2, 4, 8 or 16.

12. The device of claim 7, further comprising means for selecting a number of the all other power requests relative to a number of the first set of power requests whereby the output voltage remains within a given tolerance margin.

13. The device of claim 12, wherein n=2, 4, 8 or 16.

14. An electronic device including circuits for controlling the switching of a low dropout regulator, the device comprising:

a signal generator for generating a signal enabling and disabling the low dropout regulator;

a control for providing a power request to the signal generator; the signal generator being responsive to the power request to generate the signal to enable the low dropout regulator at a time corresponding to a start of the power request and for an active enabled time of a duration the actual active time of the power request and long enough to sufficiently settle the output voltage of the low dropout regulator, and to disable the low dropout regulator after the active enabled time, the control being a microprocessor or microcontroller;

wherein the signal generator and control operate cooperatively to prolong the active enabled time of the low dropout regulator relative to the actual active time of the power request, for every nth power request, wherein n is greater than one; and wherein the signal generator and control operate cooperatively to prolong the active enabled time of the low dropout regulator relative to the actual active time of the power request, wherein n is determined on the basis of a predetermined tolerance range of an output voltage of the low dropout regulator.

* * * * *